US007754405B2

(12) United States Patent
Kashiwabara et al.

(10) Patent No.: US 7,754,405 B2
(45) Date of Patent: Jul. 13, 2010

(54) TONER FOR ELECTRONIC PRINTING, AND PROCESS FOR PRODUCING GLASS PLATE HAVING ELECTRIC CONDUCTOR PATTERN

(75) Inventors: Satoshi Kashiwabara, Chiyoda-ku (JP); Kazuo Sunahara, Chiyoda-ku (JP); Naoki Okahata, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 778 days.

(21) Appl. No.: 11/617,219

(22) Filed: Dec. 28, 2006

(65) Prior Publication Data

US 2007/0154829 A1 Jul. 5, 2007

(30) Foreign Application Priority Data

Jan. 5, 2006 (JP) ..... 2006-000639

(51) Int. Cl.
*G03G 9/08* (2006.01)
*G03G 13/20* (2006.01)

(52) U.S. Cl. ..... 430/108.1; 430/109.1; 430/120.2; 430/123.51; 430/123.52; 430/124.14

(58) Field of Classification Search ..... 430/108.1, 430/108.6, 109.1, 110.2, 120.2, 123.51, 123.52, 430/124.14
See application file for complete search history.

(56) References Cited

U.S. PATENT DOCUMENTS 5,988,068 A 11/1999 Van Ritter et al.
2005/0106486 A1* 5/2005 Schultheis et al. ..... 430/108.1

FOREIGN PATENT DOCUMENTS

| | | |
|---|---|---|
| DE | 202 00 229 U1 | 5/2002 |
| JP | 2002-244337 | 8/2002 |
| JP | 2003-188622 | 7/2003 |
| JP | 2005-99878 | 4/2005 |
| WO | WO 03/058351 A1 | 7/2003 |

OTHER PUBLICATIONS

U.S. Appl. No. 12/324,985, filed Nov. 28, 2008, Okahata, et al.
U.S. Appl. No. 12/327,140, filed Dec. 3, 2008, Okahata, et al.
U.S. Appl. No. 11/620,312, filed Jan. 5, 2007, Kashiwabara, et al.
Derwent Publications, AN 2004-074871 [8], XP-002424399, JP 2002-244337, Aug. 30, 2002 (JP 2002-244337 previously filed on Dec. 28, 2006).
U.S. Appl. No. 12/061,093, filed Apr. 2, 2008, Okahata, et al.
U.S. Appl. No. 11/564,922, filed Nov. 30, 2006, Satoshi Kashiwabara, et al.

* cited by examiner

*Primary Examiner*—Janis L Dote
(74) *Attorney, Agent, or Firm*—Oblon, Spivak, McClelland, Maier & Neustadt, L.L.P.

(57) ABSTRACT

Toners having toner matrix particles having conductive fine particles, a heat decomposable binder resin and glass frit, and heat decomposable organic resin fine particles attached on the surface of the toner matrix particles. The heat decomposition temperature of the organic resin in the heat decomposable organic resin fine particles is lower than the heat decomposition temperature of the heat decomposable binder resin.

20 Claims, 2 Drawing Sheets

TONER FOR ELECTRONIC PRINTING, AND PROCESS FOR PRODUCING GLASS PLATE HAVING ELECTRIC CONDUCTOR PATTERN

The present invention relates to a toner for electronic printing, and a process for producing a glass plate having an electric conductor pattern. Particularly, it relates to a toner for electronic printing capable of forming a pattern of an electric conductor excellent in adhesion to the surface of a glass plate to be used for a window of an automobile or the like, and a process for producing a glass plate having an electric conductor pattern.

A glass plate to be used for a window of an automobile, is provided with conductive wiring as heater wires for defogging or as antenna wiring for receiving radio, television or the like. Such conductive wiring is provided mainly on a rear window or on a rear side window of an automobile. The conductive wiring consists mainly of a fired product of a paste containing silver. Specifically, a paste having silver and glass frit incorporated in a resin solution, is printed on a glass plate in a predetermined pattern by screen printing, and then the glass plate is heated to decompose the resin content and to fix silver on the glass plate by the glass frit, followed by firing silver to form conductive wiring on the glass plate.

There is a restriction to the voltage in the electrical system to be used for an automobile, and in order to obtain the desired heat generation, it is necessary to set the resistance of heater wires at a prescribed level. Further, in order to receive radio waves by a prescribed antenna pattern, it is necessary to set the resistance of the antenna wiring at a prescribed level. The resistance of the conductive wiring depends on the wiring width or wiring thickness.

On the other hand, in order to sufficiently remove fogging or to receive radio waves with a desired sensitivity over the entire region of a window, it is necessary to design a pattern for the heater wires or antenna wiring. By a computer simulation, it is possible to predict to some extent how much fogging can be removed or what grade of antenna performance can be obtained by such a pattern. Further, it has been proposed to simply adhere a conductive tape on a glass plate to preliminarily measure various performances (e.g. Patent Document 1). However, to know the final performance for removal of fogging or antenna performance, it is necessary to actually provide conductive wiring and measure the respective performances.

Accordingly, there may be a case wherein even after the preparation of a screen based on the prediction of substantially the final stage and production of a glass plate with conductive wiring, the pattern of the conductive wiring will have to be changed. In such a case, the screen has to be modified to meet the modified pattern.

Automobiles are mass production products, and likewise window glass plates to be used for automobiles are mass production products. Accordingly, once a pattern is determined for conductive wiring, it is required that a conductive paste is sequentially printed on a large quantity of glass plates in the determined pattern. In such mass production, screen printing of a conductive paste by means of a screen is suitable. However, as mentioned above, even if a screen having a pattern substantially determined, is prepared, it will be necessary to modify the screen to have the pattern adjusted to make the heat generation performance or antenna performance to be finally desired. Besides, in a case where the glass plates are to be used for windows of automobiles, the shapes of the glass plates, the shapes of patterns of conductive wirings, etc. may vary depending upon the types of the automobiles. Accordingly, depending upon the types of the automobiles, screens will have to be prepared, and many screens will have to be stocked. Thus, it is desired to develop a process for producing glass plates with conductive wiring, whereby no modification of a screen is required, and to develop a conductive composition for such a process.

On the other hand, it has been proposed in recent years to print a toner (ink) comprising conductive fine particles made of metal such as silver and a thermoplastic resin on an inorganic substrate by an electronic printing method, followed by firing to form a conductive wiring pattern, and various toners for electronic printing have been proposed. As a typical example, a toner for electronic printing (Patent Document 2) has been proposed wherein conductive fine particles are covered with a thermoplastic resin to form capsules, to which glass frit, etc. are added. However, in such a toner for electronic printing, a thermoplastic resin such as a styrene/acrylate copolymer resin is used, and when fired, such a resin will remain as a char in the conductive wiring to block sintering of the conductive fine particles to one another, whereby the electrical characteristic (the resistance) of the obtained conductive wiring was not adequate as a wiring pattern. Further, the adhesion of the conductive wiring to the inorganic substrate after the firing was not satisfactory.

On the other hand, it is known to have the surface of toner matrix particles covered with an additive composed of inorganic spherical fine particles of e.g. silica or titanium oxide, for the purpose of improving the flowability of the toner to improve the resolution thereby to obtain an excellent image at the time of printing a colored toner on paper surface by an electronic printing method (e.g. Patent Document 3). However, as a result of an extensive study by the present inventors, it has been found that if such an additive composed of inorganic spherical fine particles is present on the surface of toner matrix particles, there will be a problem such that the adhesion of the binder (resin) in the toner matrix particles to the glass plate surface will be impaired during the thermal transfer to the glass plate surface, whereby the transfer rate will be substantially deteriorated. Further, in a case where an additive composed of inorganic spherical fine particles is printed on the glass plate surface by electronic printing, even after the firing, the inorganic spherical fine particles will remain in the conductive wiring, whereby there has been also a problem that the electrical characteristics (specific resistance value) of the conductive wiring thereby obtainable, will be substantially impaired. Further, in a case where inorganic spherical fine particles are used as an additive to toner matrix particles containing glass frit, the inorganic spherical fine particles will be present in the glass frit melted under heating, whereby there will be a problem such that the adhesion of the conductive fine particles to the glass plate surface will deteriorate, and the adhesive strength between the conductive wiring and the glass plate surface after the firing will be impaired. Accordingly, it has been desired to develop a toner for electronic printing capable of transferring conductive wiring on a glass plate surface by an electronic printing method in high image quality and at a high transfer rate, and an additive therefor.

Patent Document 1: JP-A-2003-188622 (Claims)

Patent Document 2: JP-A-2002-244337 (Claims)

Patent Document 3: JP-A-2005-99878 (Claims, Examples)

The present invention relates to a toner for electronic printing and a process for producing a glass plate having an electric conductor pattern. Particularly, it is an object of the present invention to provide a toner for electronic printing capable of forming a pattern of an electric conductor excellent in adhesion to the surface of a glass plate to be used for a window of e.g. an automobile, in high image quality at a high transfer rate and a process for producing a glass plate having an electric conductor pattern.

The present invention provides a toner for electronic printing as defined in the following (1) to (9) and a process for producing a glass plate having an electric conductor pattern as defined in the following (10) to (12)

(1) A toner for electronic printing, which comprises toner matrix particles comprising conductive fine particles, a heat decomposable binder resin and glass frit, and heat decomposable organic resin fine particles attached on the surface of the toner matrix particles, wherein the heat decomposition temperature of the organic resin in the heat decomposable organic resin fine particles is lower than the heat decomposition temperature of the heat decomposable binder resin.

(2) The toner for electronic printing according to (1), wherein the toner matrix particles have an average particle diameter of from 10 to 35 μm.

(3) The toner for electronic printing according to is (1) or (2), wherein the heat decomposable organic resin fine particles have an average particle diameter of from 10 to 800 nm.

(4) The toner for electronic printing according to any one of (1) to (3), wherein the toner matrix particles comprise, based on 100 parts by mass of the total solid content of the toner matrix particles, from 59.8 to 94.8 parts by mass of the conductive fine particles, from 5 to 40 parts by mass of the heat decomposable binder resin and from 0.2 to 5 parts by mass of the glass frit.

(5) The toner for electronic printing according to any one of (1) to (4), wherein the heat decomposable organic resin fine particles are in an amount of from 0.1 to 5 parts by mass per 100 parts by mass of the toner matrix particles.

(6) The toner for electronic printing according to any one of (1) to (5), wherein the glass frit has a melting temperature of from 450 to 500° C.

(7) The toner for electronic printing according to any one of (1) to (6), wherein the heat decomposable binder resin has $T_{100}$ of from 425 to 450° C., and the organic resin in the heat decomposable organic resin fine particles has $T_{100}$ of from 250 to 420° C., where $T_{100}$ is a temperature at the time when a weight change of the resin has become no longer observed during a temperature rise from room temperature at a rate of 10° C./min by means of a thermogravimetric analyzer (TG).

(8) The toner for electronic printing according to any one of (1) to (7), wherein the heat decomposable binder resin is a heat decomposable resin having acid groups and having an acid value of from 5 to 100.

(9) The toner for electronic printing according to any one of (1) to (7), wherein the heat decomposable binder resin is a heat decomposable resin having an acid value of from 20 to 100.

(10) A process for producing a glass plate having an electric conductor pattern, which comprises a step of using the toner as defined in any one of (1) to (9) and forming a pattern of the toner on a surface of a glass plate by an electronic printing system, and a step of heating the glass plate having the pattern of the toner formed on its surface at a temperature at which the heat decomposable binder resin and the heat decomposable organic resin fine particles disappear and the glass frit melts, to convert the pattern of the toner to a pattern of an electric conductor.

(11) The process for producing a glass plate having an electric conductor pattern according to (10), wherein the temperature for heating the glass plate is from 600 to 740° C.

(12) The process for producing a glass plate having an electric conductor pattern according to (10) or (11), wherein at the same time as the glass plate is heated to convert the pattern of the toner to a pattern of an electric conductor, the heated glass plate is subjected to thermal processing.

According to the present invention, a predetermined electric conductor pattern is formed by electronic printing, whereby it is not required to have a screen ready for every pattern. Further, the toner of the present invention to be used for such electronic printing is capable of forming an electric conductor pattern excellent in adhesion to the glass plate surface. Particularly, the toner of the present invention is capable of forming an electric conductor pattern excellent in electrical characteristics (specific resistance value) in a high transfer rate, whereby it is possible to easily form an electric conductor pattern having desired heat generation performance or antenna performance.

In the present invention, electronic printing means printing by a xerography system. The xerography system is basically such that an electrostatically charged photoconductor drum is exposed to form an electrostatic latent image, the latent image is developed by a toner to form a pattern of the toner on the photoconductor drum surface, and then this pattern of the toner is transferred from the photoconductor drum surface to the surface of a substrate (in the present invention, to the surface of a glass plate). The present invention is an invention of a toner suitable for such electronic printing.

When the toner of the present invention is heated to a predetermined temperature, the heat decomposable binder resin and the heat decomposable organic resin fine particles in the toner will disappear and the glass frit starts to be melted. When the temperature is further raised, the conductive fine particles will be sintered and bonded to one another, and the molten glass is considered to fill spaces between the conductive fine particles thus sintered. It is considered that when the molten glass is then cooled and solidified, an electric conductor comprising the bonded electroconductive fine particles and the solidified glass filling the spaces between the particles, will be produced. The pattern formed by the toner of the present invention is then heated to the above predetermined temperature and then cooled, whereby it is converted to a pattern of an electric conductor. Heating to the temperature at which the heat decomposable binder resin and the heat decomposable organic resin fine particles in the toner will disappear and the glass starts to be melted, will hereinafter be referred to also as firing, and the temperature therefor will be referred to also as firing temperature. The toner of the present invention is a toner which is suitable for an application wherein a toner pattern formed by electronic printing is converted to a pattern of an electric conductor by firing.

The substrate on which a pattern of an electric conductor is formed by the toner of the present invention, may be any substrate made of a material durable at the above-mentioned predetermined temperature. As the substrate in the present invention, a glass plate is preferred, and particularly preferred is a glass plate to be used for a window of an automobile. The present invention also provides a process for producing a glass plate having an electric conductor pattern, which comprises forming an electric conductor pattern on the surface of a glass plate by using such a toner.

In the present invention, the electric conductor pattern may be a pattern made of a line-form conductor or a pattern made of a strip-form conductor, or a pattern made of a combination of a line-form conductor and a strip-form conductor. For example, as shown in FIG. 3, a defogger or an antenna is constituted by a pattern made of a line-form conductor, while a bus bar is constituted by a pattern made of a strip-form conductor.

In the accompanying drawing

Figure 1:
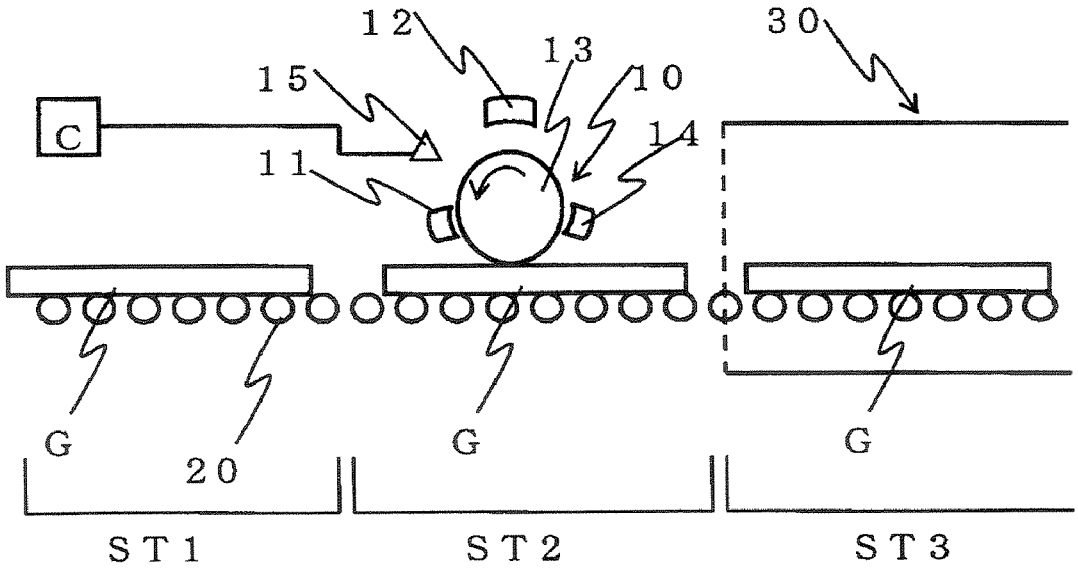
FIG. 1 is a schematic side view illustrating an example of a continuous process for producing a glass plate having an electric conductor pattern of the present invention.

1: Defogger
2: Antenna wiring
3: Busbar
4: Dark colored ceramic fired product
10: Electronic printing apparatus
11: Toner feeder
12: Electrification device
13: Photoconductor drum
14: Static eliminator
15: Light source
20: Conveyor roll
30: Heating furnace
G: Glass plate
C: Computer
ST1: Chamfering step
ST2: Printing step
ST3: Firing step
ST4: Inspection step Now, an embodiment of the present invention will be described with reference to the drawings.

FIG. 1 is a schematic side view illustrating an example of a continuous process for producing a glass plate having an electric conductor pattern of the present invention. The glass plate G is transported to a printing step via a step (ST1) of cutting into a predetermined shape, chamfering, cleaning, etc. In the printing step ST2, the toner of the present invention is printed in a predetermined pattern on the glass plate G by an electronic printing apparatus 10. The glass plate G having the toner printed in a prescribed pattern is transported into a heating furnace 30. In the heating furnace 30, the glass plate G is heated to a predetermined temperature, and the toner is fired on the glass plate G and converted to an electric conductor, whereby a glass plate having a predetermined electric conductor pattern is prepared. The formed electric conductor pattern is transported to an inspection step (ST4, not shown) and inspection of the resistance value is carried out. The result of the inspection in the inspection step ST4 is transmitted to a computer C, whereupon after judgment whether or not the desired electric heating performance or antenna performance is obtainable, the judged information is converted to information for adjustment of the pattern such as the shape of the pattern or the wiring width, which is utilized for the control of the printing pattern in a printing step ST2.

In the step ST1, a rectangular glass plate is cut into a predetermined shape, and the cut surface is chamfered. Then, the glass plate is cleaned and, if necessary, preheated and transported to the printing step ST2 by conveyor rolls 20.

In the printing step ST2, a photoconductor drum 13 is subjected to removal of electricity by a static eliminator 14 while the photoconductor drum is rotated. Then, the photoconductor drum is charged by an electrification device 12 and irradiated with an exposure light from a light source 15 to have the photoconductor drum exposed with a predetermined pattern. Then, the exposed surface of the photoconductor drum 13 is rotated to a toner feeder 11 for presenting a toner to the photoconductor drum, whereby a toner layer is formed in a predetermined pattern on the surface of the photoconductor drum 13. The toner layer in the predetermined pattern on the surface of the photoconductor drum 13 will be transferred to the surface of a glass plate G transported by the rotation of the photoconductor drum 13. Thus, a tone layer of a predetermined pattern is formed on the surface of the glass plate G. At that time, a secondary transfer plate 5 such as an intermediate transfer belt may be interposed between the photoconductor drum 13 and the surface of the glass plate G.

In the computer C, the pattern information to have exposure light irradiated to carry out exposure in a predetermined pattern, is stored. Accordingly, by a direction from the computer C, an exposure light from the light source 15 is irradiated in a predetermined pattern. In a case where the glass plate G is to be used for a window of an automobile, the shape of the glass plate, the shape of the electric conductor pattern, etc. vary depending upon the type of the automobile. Accordingly, on the basis of such data corresponding to the type of the automobile, the instruction signal may be changed, and it is thereby possible to easily change from the production of a glass plate of a certain type to the production of a glass plate of another type.

The glass plate G having a toner layer of a predetermined pattern, is transported into a heating furnace 30 and heated at a predetermined temperature, usually from about 600 to 740° C. The toner is thereby fired on the surface of the glass plate G, whereby an electric conductor of a predetermined pattern is formed on the glass plate. Usually, a glass plate for a window of an automobile is curved. Accordingly, when the glass plate having an electric conductor pattern prepared as described above, is to be used for a window of an automobile, it is heated in the firing step ST3 and subjected to reinforcing treatment via bending processing. Here, there may be a case where instead of reinforcing treatment, annealing treatment may be carried out (bending of the glass plate for laminated glass). Thermal processing of the glass plate means that the glass plate is heated to carry out bending or reinforcement treatment. Further, the temperature for the thermal processing of the glass plate will hereinafter be referred to as a thermal processing temperature.

The lower limit of the above-mentioned firing temperature is the lowest temperature at which disappearance of the binder resin and melting of the glass frit take place (preferably sintering of the conductive fine particles also takes place), and the upper limit of the firing temperature is usually whichever is lower the temperature at which the conductive fine particles melt or the temperature at which the molten glass disappears. The temperature for the above-mentioned thermal processing is usually a temperature of at least such a lower limit of the firing temperature. Accordingly, by heating the glass plate to such a thermal processing temperature, firing of the toner will take place during the heating process.

When the toner is fired, a composition comprising the conductive fine particles and molten glass frit will be formed. Further, it is preferred that the conductive fine particles will be in a sintered state (i.e. the fine particles will be in a state of being bonded to one another while maintaining the fine particle shape). In such a case, the molten glass frit is considered to fill spaces between the sintered conductive fine particles. Further, it is conceivable that the conductive fine particles will form an electric conductor without being sintered. In such a case, it is considered that the conductive fine particles maintain the mutually contacted state, and molten glass frit will fill the spaces between the conductive fine particles to bond the conductive fine particles one another. Thereafter, the glass plate is cooled, whereby molten glass will be solidified, and it will be possible to obtain an electric conductor comprising the electroconductive fine particles and solidified glass.

The toner for electronic printing of the present invention (hereinafter referred to as the present toner) comprises toner matrix particles (hereinafter referred to as the present toner matrix particles) comprising conductive fine particles, a heat decomposable binder resin (hereinafter referred to as the present binder resin) and glass frit, and heat decomposable organic resin fine particles attached on the surface of the toner matrix particles. The heat decomposable organic resin fine particles have a function to maintain high flowability of the toner powder until they are supplied to the photoconductor drum. The present binder resin is a component which functions as a binder to bond a conductive fine particle and glass frit as one matrix particle, or which functions as a binder to transfer the toner pattern on e.g. a photoconductor drum to the substrate and to fix the conductive fine particles and glass frit on the substrate until the glass frit will melt.

In the heating process after the pattern of the present toner is formed on the glass plate, firstly, the organic resin constituting the heat decomposable organic resin fine particles will be decomposed and vaporized, whereby the fine particles will disappear, and then, the present binder resin in the present toner matrix particles will be decomposed. The decomposed present binder resin will be vaporized and will disappear from the glass plate by heating. After majority of the present binder resin has been vaporized, the glass frit begins to be melted, and the conductive fine particles in the present toner matrix particles will be fixed on the glass plate surface mainly by the adhesive property of the glass frit. In such a process, the present binder resin is completely decomposed and evaporated during the period until the glass frit is completely melted, whereby the amount of the resin remaining in the electric conductor after the firing can be reduced. Finally, the glass plate is heated to a temperature exceeding 600° C., whereby the conductive fine particles will be sintered to form an electric conductor.

It is preferred that the lower limit of the firing temperature is almost the same as or higher temperature than the melting temperature Ts of the glass frit, and $T_{100}$ of the present binder resin (temperature at which disappearance of the present binder resin substantially take places) is almost the same or lower temperature than Ts. On the basis of such Ts, if $T_{100}$ of the present binder resin is too high as compared with Ts, a decomposed product of the present binder resin remains in the conductor. Further, if $T_{100}$ of the present binder resin is too low as compared with Ts, the present binder resin is completely decomposed before melting of the glass frit takes place, whereby the conductor is unlikely to be sufficiently fixed on the surface of the glass plate. Accordingly, it is preferred that, as the present binder resin, a resin having an appropriate $T_{100}$ is selected in accordance with Ts of the glass frit.

Further, $(T_{100}-T_{90})$ of the present binder resin is preferably from 0.1 to 15° C. When $(T_{100}-T_{90})$ is at least 0.1° C., a small amount of the present binder resin is remaining even at the time when the glass frit starts to be melted, near Ts, the electric conductor can be better fixed to the glass plate surface by the adhesive property of both the resin and the glass frit, and it is thereby possible to increase the adhesion of the electric conductor to the glass plate surface. On the other hand, when $(T_{100}-T_{90})$ is at most 15° C., the present binder resin can be sufficiently decomposed before the glass frit is completely melted, whereby the present binder resin will scarcely remain as a char in the electric conductor, and sintering failure of the conductive fine particles to one another will scarcely result. $(T_{100}-T_{90})$ is particularly preferably from 5 to 15° C.

Here, the above $T_{100}$ is a temperature at the time when a weight change has become no longer observed during a temperature rises from room temperature at a rate of 10° C./min by means of a thermogravimetric analyzer (TG). Further, the above $T_{90}$ is a temperature at the time when weight reduction of the present binder resin has become 90 wt % during a temperature rise from room temperature at a rate of 10° C./min by means of a thermogravimetric analyzer (TG).

The conductive fine particles may, for example, be metal fine particles or conductive oxide fine particles. As the metal fine particles, fine particles of gold, platinum, silver or copper are preferred. As the conductive oxide fine particles, fine particles of ITO (indium-doped tin oxide) or ATO (antimony-doped tin oxide) are preferred. In a case where the glass plate having a pattern of a line-form conductor formed is to be used for a window of an automobile, the width of the conductor can not be made so large, since it is necessary to ensure that the formed pattern of the conductor will not block the eyesight. Accordingly, it is particularly preferred to select fine particles of silver as the conductive fine particles in order to obtain a desired resistance value with a narrow wiring width.

The content of the conductive fine particles is preferably from 59.8 to 94.8 parts by mass per 100 parts by mass of the total solid content of the present toner matrix particles. When the content of the conductive fine particles is at least 59.8 parts by mass, the electrical conductivity of the electric conductor can sufficiently be maintained, and the volume shrinkage of the electric conductor formed by firing at the time of cooling can be suppressed, whereby its peeling from the glass plate surface or cracking can be prevented. Further, when it is at most 94.8 parts by mass, constant electrification can be attained as a toner. The content of the conductive fine particles is particularly preferably from 69.8 to 89.8 parts by mass.

The conductive fine particles preferably have an average particle diameter of from 0.2 to 20 μm. When the average particle diameter is at least 0.2 μm, the volume shrinkage of the obtainable electric conductor will be suppressed, and its peeling from the glass plate surface can be prevented. On the other hand, when the average particle diameter is at most 20 μm, the print quality of the obtainable electric conductor pattern can be made high. The conductive fine particles particularly preferably have an average particle diameter of from 0.5 to 10 μm. The average particle diameter can be measured by a conventional method, and, for example, can be measured by using a particle size distribution meter of e.g. a flow system, a laser diffraction/scattering system or a dynamic light scattering system.

Among them, it is particularly preferred to use a flow system particle size distribution meter, since it is thereby possible to accurately measure even a low frequency particle size distribution, or to measure the shape of particles at the same time as the average particle diameter.

As the glass frit, any glass frit may be used irrespective of lead-type or non-lead-type. However, from the viewpoint of environment, etc., a bismuth-silica glass frit of non-lead-type is preferred. The melting temperature Ts of the glass frit is preferably from 400 to 550° C., particularly preferably from 450 to 500° C. When the melting temperature Ts of the glass frit is from 400° C. to 550° C., it is possible to easily select the binder resin with $T_{100}$ satisfying the relation between the above Ts and $T_{100}$ of the present binder resin, and particularly when the melting temperature Ts of the glass frit is from 450° C. to 550° C., it is possible to easily use a binder resin with good decomposition properties. Further, if Ts of the glass frit exceeds 550° C., such a temperature is too close to 600° C. which is the lower limit of the usual processing temperature of the glass plate, whereby the glass frit is unlikely to melt sufficiently at the time of thermal processing of the glass plate.

The present binder resin is a heat decomposable resin having the above-mentioned functions, and the type of the resin is not limited so long as it has the appropriate heat decomposition temperature and functions as a binder. However, the present binder resin is preferably a heat decomposable resin having functional groups, in order to provide functions such that the toner is unlikely to aggregate before it is supplied to the photoconductor drum; the toner adheres to the photoconductor drum by an appropriate adhesiveness; the toner pattern on the photosensitive drum can be properly transferred to the substrate; and further, the fixing property of the toner pattern transferred to the substrate is good. Further, such functional groups are preferably acidic groups such as carboxyl groups.

The present binder resin is preferably a heat decomposable resin containing, as the main component, an acid-modified thermoplastic resin having an acid value of at least 5, whereby the fixing property to the glass plate surface is excellent and the decomposition property during the heat treatment is also excellent. Here, the acid value is the number of mg of potassium hydroxide which is required to neutralize the acidic groups which are present in 1 g of a resin. The reason for the excellent fixing property by employing the heat decomposable resin containing, as a main component, an acid-modified thermoplastic resin having an acid value of at least 5, is not clearly understood, but it is considered to be attributable to an interaction between the acidic groups in the binder resin and silanol groups at the surface of the glass plate. Here, the present binder resin may be made solely of the acid-modified thermoplastic resin, or a combination of the acid-modified thermoplastic resin with other heat decomposable resins (for example, a thermoplastic resin having no acidic groups) In the latter case, it is preferred that the proportion of the heat decomposable resins other than the acid-modified thermoplastic resin is relatively small to the acid-modified thermoplastic resin, and the proportion is preferably at most 30 mass %, particularly preferably at most 10 mass %, based on the total resin amount of the present binder resin. It is preferred that both of the polymer in the main chain in the acid-modified thermoplastic resin and the polymer of the main chain in other heat decomposable resins are polymers obtainable by vinyl polymerization. Types of both main skeletons may be the same or different. Even in the case of containing other heat decomposable resins, it is preferred that the acid value of the present binder resin is at least 5, and the acid value of the entire resin containing such other heat decomposable resin having no acidic groups is at least 5. Further, as the acid-modified thermoplastic resin or other heat decomposable resins in the present binder resin, it is possible to use commercial products.

The acid value of the present binder resin is preferably from 5 to 100, more preferably from 20 to 100. It is thereby possible to form a pattern excellent in the fixing property when the present toner is electro-printed on a glass plate surface. When the acid value is at least 5, particularly at least 20, the number of acidic groups can be secured, whereby the fixing property of the pattern will be stabilized and, adhesion failure of the electric conductor after the firing will scarcely result. On the other hand, when the acid value is at most 100, the melt viscosity of the present binder resin will not be too high, and the present toner can be sufficiently fixed to the substrate surface by electronic printing, and a failure such as offset on the photoconductor drum will scarcely result. The acid value is more preferably from 30 to 70.

The acid-modified thermoplastic resin is a polymer having acidic groups, and the acidic groups in the present invention are carboxyl groups or carboxylic anhydride groups. The acid-modified thermoplastic resin is a thermoplastic resin having either or both of the carboxyl groups and the carboxylic anhydride groups. The acid-modified thermoplastic resin is preferably a polymer obtainable by copolymerizing a monomer having an acidic group or a polymer obtainable by reacting a compound having an acidic group with a thermoplastic resin. Further, it is also possible to obtain a polymer containing acidic groups by hydrolysis of a polymer obtained by copolymerizing an unsaturated carboxylate monomer. The acid-modified thermoplastic resin in the present invention is particularly preferably an acid-modified thermoplastic resin obtainable by reacting a compound having an acidic group with a thermoplastic resin previously produced.

The main monomer constituting the acid-modified thermoplastic resin may, for example, be an olefin, an aromatic vinyl monomer such as styrene, a (meth)acrylate monomer such as an acrylate or a methacrylate, an unsaturated alcohol ester monomer such as vinyl acetate, or a diene monomer such as butadiene. Particularly preferred is a thermoplastic resin obtainable from an olefin having at most 6 carbon atoms such as ethylene or propylene as the main monomer.

The compound having an acidic group (hereinafter referred to as an acid-modifying agent) is preferably an unsaturated carboxylic acid or an unsaturated polycarboxylic anhydride. It is particularly preferably an unsaturated dicarboxylic acid or an unsaturated dicarboxylic anhydride. Specifically, acrylic acid, methacrylic acid, maleic acid, fumaric acid, itaconic acid, citraconic acid, maleic anhydride, itaconic anhydride or citraconic anhydride may, for example, be mentioned. The acid-modifying agent is particularly preferably maleic anhydride. Accordingly, the acid-modified thermoplastic resin is preferably an acid-modified thermoplastic resin obtainable by reacting an unsaturated carboxylic acid or an unsaturated carboxylic anhydride with a thermoplastic resin, particularly preferably a maleic anhydride-modified thermoplastic resin.

The acid-modified thermoplastic resin is preferably an acid-modified polyolefin obtainable by reacting a compound having acidic groups with a polyolefin. The polyolefin may, for example, be a polyethylene, polypropylene or an ethylene-propylene copolymer, and among them, polypropylene is preferred since constant electrification can thereby be easily secured as a toner. The method of reacting an acid-modifying agent with a polyolefin, may, for example, be a method wherein the acid-modifying agent and a radical generator (such as a peroxide) are mixed in a polyolefin, followed by heating to react them, or a method wherein the acid-modifying agent is mixed and reacted to a low-molecular-weight polyolefin (having reaction sites such as unsaturated groups) obtainable by previously subjecting a polyolefin to partial heat decomposition. As the acid-modified polyolefin, it is preferred to employ a maleic anhydride-modified polyolefin, particularly a maleic anhydride-modified polypropylene, obtainable by means of such a method, from the viewpoint of the degree of electrification, the rising speed of the electrification and the stability of the electric charge. Further, the weight average molecular weight of the acid-modified polyolefin is not particularly limited, but is preferably from 3,000 to 150,000, particularly preferably from 5,000 to 80,000.

With regard to the heat decomposition property of the present binder resin, it is preferred to have an appropriate $T_{100}$ depending upon the melting temperature Ts of the glass frit as mentioned above. Accordingly, it is preferred that a heat decomposable resin having an appropriate $T_{100}$ is selected depending upon the value of Ts of glass frit to be used. The difference ($Ts-T_{100}$) between the melting temperature Ts of the glass frit and $T_{100}$ of the above present binder resin is preferably from 0 to 20° C. When ($Ts-T_{100}$) is from 0 to 20°

C., it is possible to initiate melting of the glass frit before the present binder resin is completely decomposed and volatilized, and it is possible to increase the adhesion of the electric conductor to the glass plate surface. In addition to the above, the difference ($Ts-T_{90}$) between the Ts and $T_{90}$ of the present binder resin is preferably from 0 to 80° C. When ($Ts-T_{90}$) is at least 0° C., a small amount of the present binder resin still remains even at the time of the glass frit starts to be melted, near Ts, the electric conductor can be fixed to the glass plate surface by the adhesive property of both the present binder resin and the glass frit. Thus, the electric conductor is believed to be sufficiently adhered to the glass plate surface. On the other hand, when ($Ts-T_{90}$) is at most 80° C., the present binder resin can be sufficiently decomposed before the glass frit is completely melted, whereby it is considered that the present binder resin tends to scarcely remain as a char in the electric conductor, sintering failure of the conductive fine particles to one another tends to hardly result, and the adhesion of the electric conductor to the glass plate surface can be made high, ($Ts-T_{90}$) is more preferably from 0.1 to 50° C.

As mentioned below, the melting temperature Ts of the glass frit is preferably from 450 to 500° C. In such a case, $T_{100}$ of the present binder resin is preferably from 420 to 450° C. In such as case, when $T_{100}$ is at least 420° C., it is possible to prevent complete decomposition of the present binder resin before melting of the glass frit, and it is possible to sufficiently fix the electric conductor to the glass plate surface. On the other hand, when $T_{100}$ is at most 450° C., at the time of firing the toner, the present binder resin will be readily decomposed and volatilized, whereby it will scarcely remain as a residual carbon in the electric conductor, and an electric conductor excellent in the electrical conductivity can be obtained without blocking the sintering of the conductive fine particles to one another, and further, it is possible to obtain an electric conductor excellent in adhesion to the glass plate surface.

The content of the present binder resin is preferably from 5 to 40 parts by mass, based on 100 parts by mass of the total solid content of the present toner matrix particles. When the content is at least 5 parts by mass, in a case where the present toner is electro-printed, its fixing property to the substrate can adequately be secured. When the content is at most 40 parts by mass, the present binder resin tends to scarcely remain in the electric conductor after the firing, whereby defects such as cracks or voids tend to scarcely result in the electric conductor. The content of the present binder resin is particularly preferably from 10 to 30 parts by mass.

Further, the content of the glass frit is preferably from 0.2 to 5 parts by mass based on 100 parts by mass of the total solid content of the present toner matrix particles. When the content of the glass frit is at least 0.2 part by mass, it is possible to secure the adhesion of the electric conductor to the substrate surface, and on the other hand, when the content is at most 5 parts by mass, it is possible to suppress an increase of the resistivity of the electric conductor pattern by an increase of the amount of the glass frit component relative to the conductive fine particles. Further, the glass frit is preferably a powder having an average particles diameter of from 0.1 to 5 μm. When the average particle diameter of the glass frit is at least 0.1 μm, its adhesion to the substrate surface can sufficiently be secured, and when the average particle diameter is at most 5 μm, it is possible to prevent exposure of the glass frit on the surface of the particles of the present toner, and the fixing property tends to scarcely decrease when the toner is printed on the substrate surface by an electronic printing method. The glass frit particularly preferably has an average particle diameter of from 0.5 to 3 μm.

To the present toner matrix particles, an inorganic pigment such as black iron oxide, cobalt blue or iron oxide red, an azo-type metal-containing dye, a salicylic acid-type metal-containing dye, or a charge-controlling agent such as a quaternary ammonium salt may, for example, be incorporated as the case requires.

The present toner matrix particles are produced, for example, by mixing the present binder resin, the conductive fine particles and the glass frit, etc., followed by kneading and cooling to prepare pellets, which are then pulverized and classified. The heating temperature is preferably from 150 to 200° C. When the heating temperature is at least 150° C., mixing of the present binder resin, the conductive fine particles and the glass frit, etc. can be carried out uniformly. On the other hand, when the heating temperature is at most 200° C., decomposition of the present binder resin can be prevented. The average particle diameter of the present toner matrix particles are preferably from 10 to 35 μm. When the average particle diameter is at least 10 μm, the conductive fine particles in the present toner matrix particles are prevented from being exposed on the surface, and the electrification of the present toner can be secured, whereby during the electronic printing, it is possible to avoid a pattern defect such as fogging due to inadequate electrification of the present toner. On the other hand, when the average particle diameter is at most 35 μm, a highly precise pattern quality can be readily obtainable.

By dispersive adhesion on the surface of the present toner matrix particles, the heat decomposable organic resin fine particles in the present toner have a function to enhance the flowability of the present toner in e.g. a toner feeder 11 without impairing the transfer ratio from e.g. photoconductor drum 13 to the glass plate surface. Further, the use of the heat decomposable organic resin fine particles can control the electrification distribution of the present toner. As an organic resin (hereinafter referred to as the present organic resin) constituting the heat decomposable organic resin fine particles, it is essential to use a resin having a lower decomposition temperature than the above present binder resin constituting the present toner matrix particles. $T_{100}$ of the present organic resin is appropriately lower by at least 5° C., preferably lower by at least 20° C., particularly preferably lower by at least 40° C., than $T_{100}$ of the present binder resin. Further, the lower limit of $T_{100}$ of the present organic resin is preferably 200° C., particularly preferably 250° C. If $T_{100}$ of the present organic resin is less than 200° C., the present organic resin is likely to have adhesive properties, whereby, in a case where the atmospheric temperature in the toner feeder becomes high, the flowability of the present toner is likely to decrease. Specifically, when $T_{100}$ of the present binder resin is from 425 to 450° C., $T_{100}$ of the present organic resin is preferably from 250 to 420° C. As the present organic resin, it is preferred to use a thermoplastic resin which is readily decomposed and volatilized by heating, and such a resin may, for example, be at least one member selected from the group consisting of polyethylene, polypropylene, polystyrene, an acrylic resin and a styrene acrylic resin. Among them, an acrylic resin and/or a styrene acrylic resin is preferred, since it can bring about an excellent electrification property of the present toner.

In the present toner, the heat decomposable organic resin fine particles preferably have a particle diameter of from 10 to 800 nm. When the particle diameter is at least 10 nm, it is possible to readily obtain effects of improving the flowability of the present toner and improving the transfer ratio and image quality. On the other hand, when the particle diameter is at most 800 nm, the heat decomposable organic resin fine particles can be uniformly dispersed on the surface of the present toner matrix particles, the flowability of the present toner can be improved, and further, the heat decomposable organic resin fine particles may be decomposed and volatilized by heating before the present binder resin in the present toner matrix particles starts to be decomposed, whereby it is possible to prevent deterioration of the fixing property between the present toner matrix particles and the substrate surface. At that time, if the ratio of the particle diameter of the heat decomposable organic resin fine particles to the particle diameter of the present toner matrix particles is adjusted to a range of [particle diameter of fine particles]/[particle diameter of the present toner matrix particle]=0.003 to 0.05, the effect of improving the flowability of the present toner can readily be obtained, such being particularly preferred.

The content of the above heat decomposable organic resin fine particles is preferably from 0.1 to 5 parts by mass based on 100 parts by mass of the present toner matrix particles. When the content is at least 0.1 part by mass, it is possible to readily obtain the effects of improving the flowability of the present toner and improving the transfer ratio and the image quality. On the other hand, when the content of the heat decomposable organic resin fine particles is at most 5 parts by mass, such fine particles are decomposed and volatilized by heating before the present binder resin in the present toner matrix particles starts to be decomposed, whereby it is possible to prevent deterioration of the fixing property between the present toner matrix particles and the glass plate surface. The content of the heat decomposable organic resin fine particles is particularly preferably from 1 to 3 parts by mass based on 100 parts by mass of the present toner matrix particles.

To the present toner matrix particles obtained as mentioned above, the above heat decomposable organic resin fine particles are attached by using a particle combining apparatus represented by HYBRIDIZATION SYSTEM (manufactured by Nara Machinery CO., LTD.) or a mixer such as HENSCHEL MIXER or path mixer, whereby the present toner can be obtained. The present toner is printed on a substrate surface by electronic printing and then fired to form an electric conductor. In a case where the substrate is a glass plate, the firing temperature is preferably from 600 to 740° C. When the firing temperature is at least 600° C., the conductive fine particles will be sufficiently sintered to one another. On the other hand, when the firing temperature is at most 740° C., deformation of the glass plate can be avoided. In the present invention, as the glass plate, soda lime glass, alkali-free glass or quartz glass may, for example, be used.

The electric conductor formed by the present invention, preferably has a resistivity of at most 20 μΩ·cm, whereby it can be used as an electric conductor for various applications such as wirings. Further, the thickness of the electric conductor is preferably from 5 to 30 μm. When the thickness is at least 5 μm, a constant resistivity can be readily obtained, and when the thickness is at most 30 μm, the desired thickness tends to be readily obtainable even by a single electronic printing operation, and thus the handling efficiency will be excellent.

Figure 2:
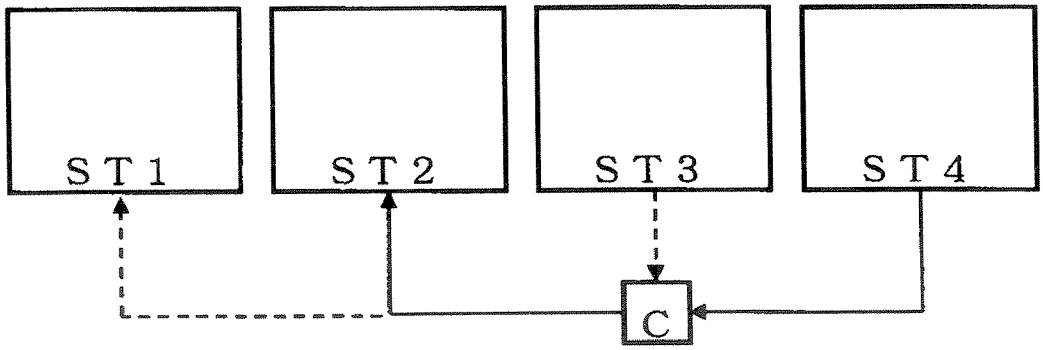
FIG. 2 is a schematic view illustrating a control process relating to a preferred embodiment of the present invention.

FIG. 2 is a schematic view illustrating a control process relating to a preferred embodiment of the present invention. On a glass plate pre-treated in ST1, a toner is printed in a predetermined pattern in the printing step ST2, and in the firing step ST3, the toner is fired by heating to obtain a glass plate having an electric conductor pattern. In the inspection step ST4 after the firing step ST3, the resistance value of the electric conductor is measured. The data of the measured resistance value are sent to a computer C for controlling the pattern of the toner in the printing step. If necessary, the temperature data in the firing step ST3 are also sent to the computer C. The data sent to the computer C are utilized as data to judge whether or not the desired electro heating performance or antenna performance is obtained. If it is judged that the desired performance is not obtained, by calculation by the computer C, the line width of the toner to be printed or the printing pattern itself is adjusted so as to obtain the desired performance. The adjusted line width of the toner or printing pattern is fed back to the printing step ST2 to form the next electric conductor on the glass plate.

If a desired electro heating performance or antenna performance can be obtained by such feeding back, it is possible to produce a glass plate having an electric conductor pattern in a large quantity by fixing the control data.

Further, in a case where the glass plate G is used for a window of an automobile, the computer C may be used to store the data of the shapes of glass plates depending upon the types of automobiles and the data of the patterns of the electric conductor, so that in the production of a glass plate for a certain type, an order based on the data relating to the electric conductor pattern corresponding to that type may be transmitted to the electric printer, whereby a change from one type to another can easily be carried out, and printing depending on each type can be carried out. Further, an order based on the data of the shape of a glass plate among data relating to various types, may be transmitted to the cutting and chamfering step (ST1) for a glass plate, whereby a change from one type to another can easily be carried out, and cutting and chamfering depending on each type can be carried out.

Figure 3:
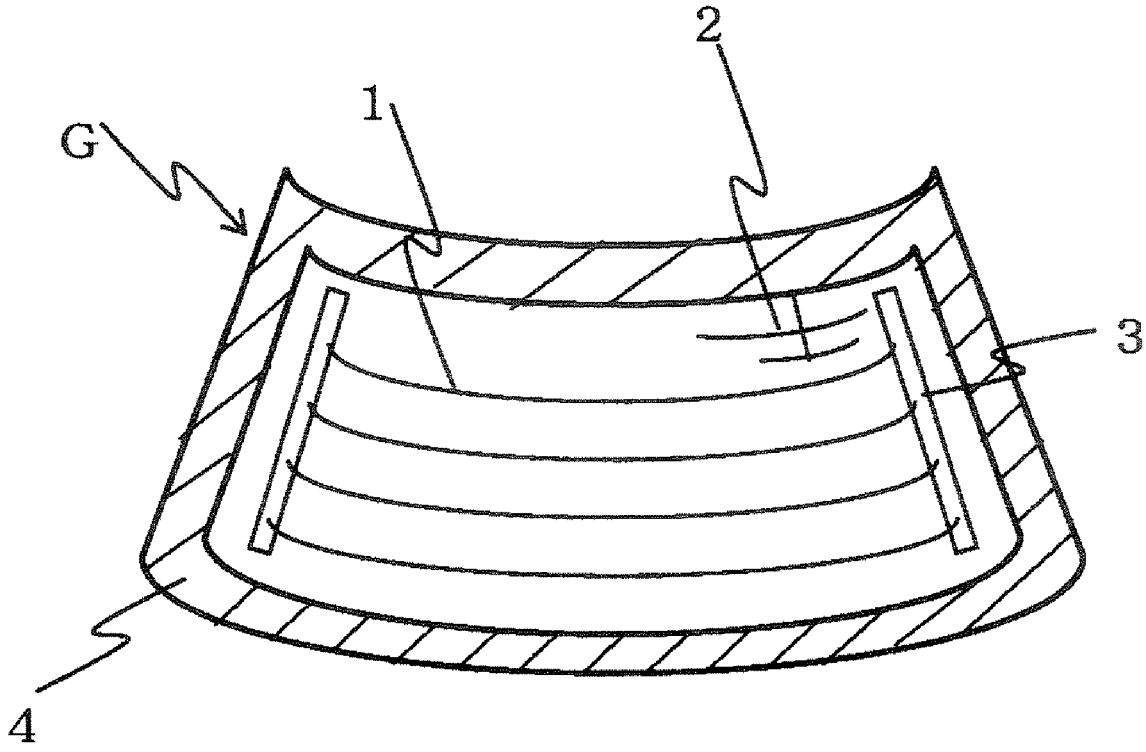
FIG. 3 is a front view illustrating an example of a rear window of an automobile.

In the printing step ST2, not only the present toner but also a colored toner may be printed on the glass plate surface. For example, on a rear window of an automobile illustrated in FIG. 3, electric conductors (defoggers 1, antenna wires 2 and bus bars 3) are provided at the center region of the glass plate G, and a dark colored ceramic fired product 4 is provided at the peripheral region. On the photoconductor drum shown in FIG. 1, a colored toner having a pigment is further printed in a predetermined pattern, whereby the colored toner may be printed together with the present toner on the glass plate surface. Like the electric conductor, a dark colored ceramic fired product used to be printed by screen printing. Accordingly, by electronically printing a colored toner together with the present toner in such a manner, the production method can be made suitable for mass production. Further, two electronic printing machines are provided to sequentially carry out the formation of a toner pattern by an electronic printing using the present toner and the formation of a toner pattern by an electronic printing using a colored toner to one glass plate, whereby it is possible to produce a glass plate having patterns of an electric conductor and a dark colored ceramic fired product.

EXAMPLES

Now, Examples 1 to 4 (Examples of the present invention) and Examples 5 to 7 (Comparative Examples) will be presented. Here, in Examples 1 to 7, with respect to the decomposition temperature, using a thermogravimetric analyzer (model: DTG-50, manufactured by Shimadzu Corporation), the measurement was carried out from room temperature to 700° C. at a temperature raising rate of 10° C./min, whereby the temperature $T_{100}$ at which a weight change of the resin disappears and the temperature $T_{90}$ at the time when the weight reduction of the resin has become 90%, were obtained. The average particle diameter of particles is a value with which the cumulative frequency becomes 50% in a cumulative particles size distribution curve based on the number of particles corresponding to circular diameters measured by using a flow particle image analyzer (tradename: FPIA-3000, manufactured by Sysmex Corporation.) Further, the average molecular weights of the resins used in Examples 1 to 7 are weight average molecular weights.

Example 1

20 Parts by mass of maleic anhydride-modified polypropylene (manufactured by Sanyo Chemical, tradename: YUMEX 1010, average molecular weight: 30,000, acid value: 52, $T_{100}$=430° C., $T_{90}$=420° C.), 79 parts by mass of silver powder (average particle diameter: 2 μm) and 1 part by mass of glass frit (bismuth-silica non-lead glass frit, melting temperature Ts: 450° C., average particle diameter: 2 μm) were mixed, kneaded at 170° C. using a kneader, and then cooled to room temperature to obtain a solid product. This solid product was pulverized by a jet mill and classified to obtain particles (toner matrix particles) having an average particle diameter of 20 μm.

To 99 parts by mass of the particles thus obtained, 1 part by mass of spherical fine particles (manufactured by Soken Chemical & Engineering Co., Ltd., tradename: MP-2200, average particle diameter: 350 nm, $T_{100}$=330° C.) made of an acrylic resin were added as heat decomposable organic resin fine particles, and the spherical fine particles made of the acrylic resin were attached to the toner matrix particles by using HYBRIDIZATION SYSTEM (manufactured by Nara Machinery CO., LTD.) to form a toner for electronic printing having an average particle diameter of 20 μm.

Using such a toner for electronic printing, a pattern of a thin line having a line width of 1 mm and a length of 80 mm was printed on a secondary transfer belt having the temperature maintained to be 180° C., by using an electronic printing machine (manufactured by Mitsubishi Heavy Industries, Ltd.), the pattern was transferred from the secondary transfer belt to a soda lime glass (length: 30 cm, width: 30 cm, thickness: 3.5 mm) having the temperature maintained to be room temperature, and then firing was carried out at 700° C. for 4 minutes to form a conductive wiring. With respect to this conductive wiring, the following evaluations were carried out. The evaluation results are shown in Table 1. Also in the following Examples 2 to 7, evaluations were carried out in the same manner.

Transfer Ratio

The transfer ratio was calculated from a ratio of an area of a pattern transferred to the surface of a glass plate/an area of a pattern printed on a belt.

Evaluation of Resistivity

The resistance value of the electric conductor pattern was measured by a resistance measuring device (manufactured by Agilent, tradename: NANO OVLT/MICRO OHM METER 34420A), and the film thickness was measured by a feeler profilometer (manufactured by ULVAC, tradename: DEKTAK8). From the resistance value and the value of the film thickness, the resistivity was calculated.

Example 2

A toner for electronic printing having an average particle diameter of 20 μm was obtained in the same manner as in Example 1 except that spherical fine particles (manufactured by Soken Chemical & Engineering Co., Ltd., tradename: MP-1451, average particle diameter: 150 nm, $T_{100}$=353° C.) made of an acrylic resin were used as heat decomposable organic resin fine particles.

Example 3

A toner for electronic printing having an average particle diameter of 20 μm was obtained in the same manner as in Example 1 except that spherical fine particles (manufactured by Soken Chemical & Engineering Co., Ltd., tradename: MP-4009, average particle diameter: 600 nm, $T_{100}$=388° C.) made of a low-temperature decomposable resin were used as heat decomposable organic resin fine particles.

Example 4

A toner for electronic printing having an average particle diameter of 20 μm was obtained in the same manner as in Example 1 except that spherical fine particles (manufactured by Soken Chemical & Engineering Co., Ltd., tradename: MP-5000, average particle diameter: 400 nm, $T_{100}$=418° C.) made of a styrene acrylic resin were used as heat decomposable organic resin fine particles.

Example 5 (Comparative Example)

A toner for electronic printing having an average particle diameter of 20 μm was obtained in the same manner as in Example 1 except that spherical silica fine particles (manufactured by Nippon Aerogel Co., Ltd., tradename: R972, average particle diameter: 16 nm, not decomposed at 700° C.) were used as fine particles to be attached to toner matrix particles.

Example 6 (Comparative Example)

A toner for electronic printing having an average particle diameter of 20 μm was obtained in the same manner as in Example 1 except that spherical silica fine particles (manufactured by Nippon Aerogel Co., Ltd., tradename: RY200, average particle diameter: 12 nm, not decomposed at 700° C.) were used as fine particles to be attached to toner matrix particles.

Example 7 (Comparative Example)

A toner for electronic printing having an average particle diameter of 20 μm was obtained in the same manner as in Example 1 except that spherical titania fine particles (manufactured by Nippon Aerogel Co., Ltd., tradename: T805, average particle diameter: 21 nm, not decomposed at 700° C.) were used as fine particles to be attached to toner matrix particles.

TABLE 1

| | Transfer ratio (%) | Resistance (Ω) | Film thickness (μm) | Resistivity (μΩ · cm) |
|---|---|---|---|---|
| Ex. 1 | 100 | 0.69 | 7.2 | 6.2 |
| Ex. 2 | 100 | 0.59 | 8.5 | 6.3 |
| Ex. 3 | 100 | 0.66 | 7.9 | 6.5 |
| Ex. 4 | 100 | 0.67 | 7.6 | 6.4 |
| Ex. 5 | 60 | 1.48 | 7.3 | 13.5 |
| Ex. 6 | 60 | 1.58 | 7.4 | 14.6 |
| Ex. 7 | 60 | 1.52 | 8.2 | 15.6 |

From the results in Table 1, it is evident that in Examples of the present invention (Examples 1 to 4) wherein heat decomposable organic resin fine particles were employed, glass plates with conductive wirings excellent in the transfer ratio and having the resistivity suppressed to be low, were obtained.

INDUSTRIAL APPLICABILITY

The present invention relates to a method for forming an electric conductor on a glass plate and a toner for an electronic printing useful for such a method, and it is particularly useful for a process for producing a glass plate with an electric conductor pattern for windows of automobiles.

The entire disclosure of Japanese Patent Application No. 2006-000639 filed on Jan. 5, 2006 including specification, claims, drawings and summary are incorporated herein by reference in its entirety.

What is claimed is:

1. A toner for electronic printing, which comprises toner matrix particles comprising conductive fine particles, a heat decomposable binder resin and glass frit, and heat decomposable organic resin fine particles attached on the surface of the toner matrix particles, wherein the heat decomposition temperature of the organic resin in the heat decomposable organic resin fine particles is lower than the heat decomposition temperature of the heat decomposable binder resin.

2. The toner for electronic printing according to claim 1, wherein the toner matrix particles have an average particle diameter of from 10 to 35 μm.

3. The toner for electronic printing according to claim 1, wherein the heat decomposable organic resin fine particles have an average particle diameter of from 10 to 800 nm.

4. The toner for electronic printing according to claim 1, wherein the toner matrix particles have an average particle diameter of from 10 to 35 μm, and the heat decomposable organic resin fine particles have an average particle diameter of from 10 to 800 nm.

5. The toner for electronic printing according to claim 1, wherein the glass frit has a melting temperature of from 450 to 500° C.

6. The toner for electronic printing according to claim 5, wherein the heat decomposable binder resin has $T_{100}$ of from 425 to 450° C., and the organic resin in the heat decomposable organic resin fine particles has $T_{100}$ of from 250 to 420° C., where $T_{100}$ is a temperature at the time when a weight change of the resin has become no longer observed during a temperature rise from room temperature at a rate of 10° C./min by means of a thermogravimetric analyzer (TG).

7. The toner for electronic printing according to claim 1, wherein the toner matrix particles comprise, based on 100 parts by mass of the total solid content of the toner matrix particles, from 59.8 to 94.8 parts by mass of the conductive fine particles, from 5 to 40 parts by mass of the heat decomposable binder resin and from 0.2 to 5 parts by mass of the glass frit.

8. The toner for electronic printing according to claim 7, wherein the toner matrix particles have an average particle diameter of from 10 to 35 μm.

9. The toner for electronic printing according to claim 1, wherein the heat decomposable organic resin fine particles are in an amount of from 0.1 to 5 parts by mass per 100 parts by mass of the toner matrix particles.

10. The toner for electronic printing according to claim 9, wherein the heat decomposable organic resin fine particles have an average particle diameter of from 10 to 800 nm.

11. The toner for electronic printing according to claim 7, wherein the glass frit has a melting temperature of from 450 to 500° C.

12. The toner for electronic printing according to claim 11, wherein the heat decomposable binder resin has $T_{100}$ of from 425 to 450° C., and the organic resin in the heat decomposable organic resin fine particles has $T_{100}$ of from 250 to 420° C., where $T_{100}$ is a temperature at the time when a weight change of the resin has become no longer observed during a temperature rise from room temperature at a rate of 10° C./min by means of a thermogravimetric analyzer (TG).

13. The toner for electronic printing according to claim 1, wherein the heat decomposable binder resin is a heat decomposable resin having acid groups and having an acid value of from 5 to 100.

14. The toner for electronic printing according to claim 13, wherein the heat decomposable binder resin is a heat decomposable resin having an acid value of from 20 to 100.

15. A process for producing a glass plate having an electric conductor pattern, which comprises a step of using the toner as defined in claim 1 and forming a pattern of the toner on a surface of a glass plate by an electronic printing system, and a step of heating the glass plate having the pattern of the toner formed on its surface at a temperature at which the heat decomposable binder resin and the heat decomposable organic resin fine particles disappear and the glass frit melts, to convert the pattern of the toner to a pattern of an electric conductor.

16. The process for producing a glass plate having an electric conductor pattern according to claim 15, wherein the temperature for heating the glass plate is from 600 to 740° C.

17. The process for producing a glass plate having an electric conductor pattern according to claim 15, wherein at the same time as the glass plate is heated to convert the pattern of the toner to a pattern of an electric conductor, the heated glass plate is subjected to thermal processing.

18. A process for producing a glass plate having an electric conductor pattern, which comprises a step of using the toner as defined in claim 6 and forming a pattern of the toner on a surface of a glass plate by an electronic printing system, and a step of heating the glass plate having the pattern of the toner formed on its surface at a temperature of from 600 to 740° C. to convert the pattern of the toner to a pattern of an electric conductor.

19. The process for producing a glass plate having an electric conductor pattern according to claim 18, wherein at the same time as the glass plate is heated to convert the pattern of the toner to a pattern of an electric conductor, the heated glass plate is subjected to thermal processing.

20. A process for producing a glass plate having an electric conductor pattern, which comprises a step of using the toner as defined in claim 12 and forming a pattern of the toner on a surface of a glass plate by an electronic printing system, and a step of heating the glass plate having the pattern of the toner formed on its surface at a temperature of from 600 to 740° C. to convert the pattern of the toner to a pattern of an electric conductor.

* * * * *